US009259612B2

(12) United States Patent
Meister et al.

(10) Patent No.: US 9,259,612 B2
(45) Date of Patent: Feb. 16, 2016

(54) EXERCISE APPARATUS AND METHODS

(71) Applicants: Gregory N. Meister, Foster City, CA (US); Charles B. Perez, Jr., Van Nuys, CA (US)

(72) Inventors: Gregory N. Meister, Foster City, CA (US); Charles B. Perez, Jr., Van Nuys, CA (US)

(73) Assignee: Meister Management, Inc., Foster City, CA (US)

( * ) Notice: Subject to any disclaimer, the term of this patent is extended or adjusted under 35 U.S.C. 154(b) by 30 days.

(21) Appl. No.: 14/254,742

(22) Filed: Apr. 16, 2014

(65) Prior Publication Data

US 2015/0297948 A1 Oct. 22, 2015

(51) Int. Cl.
*A63B 26/00* (2006.01)
*A63B 23/035* (2006.01)
(Continued)

(52) U.S. Cl.
CPC ..... *A63B 23/03566* (2013.01); *A63B 21/00065* (2013.01); *A63B 21/023* (2013.01); *A63B 21/0555* (2013.01); *A63B 21/0557* (2013.01); *A63B 21/1446* (2013.01); *A63B 21/1453* (2013.01); *A63B 21/1465* (2013.01); *A63B 21/1469* (2013.01); *A63B 21/154* (2013.01); *A63B 23/0488* (2013.01);
(Continued)

(58) Field of Classification Search
CPC ..... A63B 21/00003; A63B 21/00018; A63B 21/00025; A63B 21/00061; A63B 21/00065; A63B 21/00087; A63B 21/0009; A63B 21/00094; A63B 21/00101; A63B 21/0012; A63B 21/00181; A63B 21/02; A63B 21/023; A63B 21/025; A63B 21/04; A63B 21/0407; A63B 21/0414; A63B 21/0421; A63B 21/0428; A63B 21/0435; A63B 21/0442; A63B 21/0552; A63B 21/0555; A63B 21/0557; A63B 21/1446; A63B 21/1453; A63B 21/1461; A63B 21/1465; A63B 21/1469; A63B 21/1488; A63B 21/15; A63B 21/151; A63B 21/154; A63B 22/0076; A63B 22/0087; A63B 22/0089; A63B 2022/0079; A63B 2022/0082; A63B 2022/0084; A63B 23/035; A63B 23/03508; A63B 23/03516; A63B 23/03525; A63B 23/0355; A63B 23/03588; A63B 23/03566; A63B 23/04; A63B 23/0405; A63B 23/0482; A63B 23/0488; A63B 23/0494; A63B 23/12; A63B 23/1209; A63B 23/1218; A63B 23/1227; A63B 23/1236; A63B 23/1245; A63B 23/1272; A63B 23/1281; A63B 2023/0411; A63B 69/06; A63B 2069/062; A63B 2069/064; A63B 2069/066; A63B 71/0009; A63B 2208/0204; A63B 2208/0209; A63B 2208/0214; A63B 2208/0223; A63B 2208/0228; A63B 2208/0233; A63B 2208/0238; A63B 2208/0242; A63B 2208/0247; A63B 2210/50; A63B 2210/52; A63B 2208/0252; A63B 2208/0257; A63B 2208/0261
See application file for complete search history.

(56) References Cited

U.S. PATENT DOCUMENTS 339,638 A * 4/1886 Goldie ..... 482/96
4,272,074 A * 6/1981 Sferle ..... 482/96
(Continued)

*Primary Examiner* — Oren Ginsberg
*Assistant Examiner* — Gary D Urbiel Goldner
(74) *Attorney, Agent, or Firm* — Gary L. Loomis; G. L. Loomis & Assoc., Inc.

(57) ABSTRACT

The present invention relates generally to exercise devices, and more specifically to exercise devices providing variable resistance when performing a wide variety of training movements. These exercise devices comprise a pulley system of elastic resistance bands or cords secured to a hinged A-shaped frame wherein the resistance imparted by the elastic bands or cords can be easily varied by engaging or disengaging individual resistance bands or lengthening or shortening individual bands.

13 Claims, 14 Drawing Sheets

(51) Int. Cl.

| | |
|---|---|
| ***A63B 21/00*** | (2006.01) |
| ***A63B 21/02*** | (2006.01) |
| ***A63B 21/055*** | (2006.01) |
| ***A63B 23/12*** | (2006.01) |
| ***A63B 23/04*** | (2006.01) |

(52) U.S. Cl.

CPC ..... *A63B 23/1218* (2013.01); *A63B 23/1227* (2013.01); *A63B 23/1236* (2013.01); *A63B 23/1245* (2013.01); *A63B 23/1281* (2013.01); *A63B 2023/0411* (2013.01)

(56) References Cited

U.S. PATENT DOCUMENTS

| | | | | | |
|---|---|---|---|---|---|
| 4,659,075 | A | * | 4/1987 | Wilkinson | 482/52 |
| 4,757,993 | A | * | 7/1988 | Rake | 482/130 |
| 4,779,867 | A | | 10/1988 | Hinds | |
| 4,848,741 | A | | 7/1989 | Hermanson | |
| 4,911,438 | A | * | 3/1990 | Van Straaten | 482/96 |
| 4,915,378 | A | * | 4/1990 | Abrahamian et al. | 482/137 |
| 5,029,850 | A | * | 7/1991 | van Straaten | 482/125 |
| 5,039,091 | A | * | 8/1991 | Johnson | 482/64 |
| 5,125,649 | A | | 6/1992 | Fuller | |
| 5,176,602 | A | | 1/1993 | Roberts | |
| 5,232,426 | A | * | 8/1993 | Van Straaten | 482/123 |
| 5,263,913 | A | * | 11/1993 | Boren | 482/96 |
| 5,312,313 | A | * | 5/1994 | Holmes et al. | 482/95 |
| 5,334,120 | A | * | 8/1994 | Rasmussen | 482/97 |
| 5,354,251 | A | * | 10/1994 | Sleamaker | 482/96 |
| 5,431,617 | A | | 7/1995 | Rattray, Jr. | |
| 5,626,546 | A | | 5/1997 | Little | |
| 5,718,659 | A | * | 2/1998 | Van Straaten | 482/130 |
| 5,816,983 | A | * | 10/1998 | Dawes et al. | 482/78 |
| 5,827,154 | A | * | 10/1998 | Gill | 482/9 |
| 5,964,684 | A | * | 10/1999 | Sokol | 482/96 |
| 5,967,955 | A | * | 10/1999 | Westfall et al. | 482/142 |
| 6,001,051 | A | * | 12/1999 | Chuan-Pin | 482/131 |
| 6,036,622 | A | * | 3/2000 | Gordon | 482/51 |
| 6,234,942 | B1 | * | 5/2001 | Yang | 482/132 |
| 6,921,355 | B2 | * | 7/2005 | Campanaro et al. | 482/95 |
| 6,981,934 | B1 | * | 1/2006 | Shifferaw | 482/133 |
| 7,226,401 | B2 | * | 6/2007 | Van Stratten et al. | 482/112 |
| 7,294,096 | B1 | * | 11/2007 | Stearns | 482/140 |
| 7,608,030 | B2 | * | 10/2009 | Splane | 482/142 |
| 7,780,585 | B1 | * | 8/2010 | Rivas | 482/140 |
| 8,137,250 | B1 | * | 3/2012 | Caban | 482/140 |
| 8,192,338 | B2 | * | 6/2012 | Solow et al. | 482/142 |
| 2003/0119635 | A1 | * | 6/2003 | Arbuckle et al. | 482/142 |
| 2004/0058788 | A1 | * | 3/2004 | Thompson | 482/95 |
| 2004/0138033 | A1 | * | 7/2004 | Van Straaten et al. | 482/112 |
| 2004/0209752 | A1 | * | 10/2004 | Thonn, Jr. | 482/140 |
| 2005/0003938 | A1 | * | 1/2005 | Henderson | 482/143 |
| 2006/0063650 | A1 | * | 3/2006 | Francis | 482/94 |
| 2009/0018000 | A1 | * | 1/2009 | Brown et al. | 482/140 |
| 2009/0247376 | A1 | * | 10/2009 | Merrithew et al. | 482/121 |
| 2013/0157824 | A1 | * | 6/2013 | Chen | A63B 21/4033 482/142 |
| 2014/0128230 | A1 | * | 5/2014 | Burcham | 482/123 |
| 2014/0141948 | A1 | * | 5/2014 | Aronson et al. | 482/128 |
| 2014/0194260 | A1 | * | 7/2014 | Campanaro et al. | 482/131 |

* cited by examiner

EXERCISE APPARATUS AND METHODS

FIELD OF THE INVENTION

The present invention relates generally to exercise devices, and more specifically to exercise devices providing variable resistance when performing a wide variety of training movements.

BACKGROUND

Various types of exercise machines and devices are well known in the art. The present marketplace includes neck systems, back systems, shoulder machines, pulleys, weights, cams and other devices. Products include Nautilus®, Cybex®, and free weights, among others. There are barbells, dumbbells, bands, tubing, multi-neck machines, and multi-hip machines. Many of the systems are reputable and of good quality, and would most certainly be of benefit to the user.

Many known exercise devices includes resilient elastic cables to provide resistance to motion. Such an exercise device are particularly useful in that, as contrasted with barbells and dumbbells, substantial resistive forces can be generated by a relatively lightweight, portable device. A principal drawback to elastic cable exercise devices, however, is the difficulty encountered in attempting to adjust the restoring force. For example, U.S. Pat. No. 4,779,867 to Hinds discloses an elastic cable exercise device comprising a cable having stirrups at each end and a bar that engages the central portion of the cable to provide a handle for the user to pull against the cable. Hinds discloses that the effective free length of the cable is adjusted by wrapping the cable about the ends of the bar. The assembly in U.S. Pat. No. 5,626,546 issued to Little invokes a wall mounted guide rail framework comprising aperture engaging pins and spaced apertures along the sides for tethering height adjustment, simple channel engagement pins secured by cotter pins, as well as handgrips, pulleys and elastic cords. U.S. Pat. No. 5,176,602 issued to Roberts also employs handgrips, pulleys and elastic cord as do the foregoing. While the patent focuses upon door stop or door impingement tethering, instructions are included therein to mount a rigid framework comprising spaced apertures upon the walls in the corner of a room, the apertures providing tethering points for apparatus connecting links. U.S. Pat. No. 4,848,741 issued to Hermanson illustrates a special framework upon which several pulley wheels are mounted in a selected pattern which permits lengthening or shortening the elastic cord to vary the tethering tension.

Therefore a need exists for a portable, lightweight, foldable apparatus with easily adjustable tension settings and is suitable for performing wide variety of exercises. A further need exists for an exercise device that utilizes bodyweight resistance to assist in performance of exercises. Such an apparatus can assist a user who cannot sufficiently perform exercises without assistance. Such an apparatus is especially adaptable and useful to individuals who may be handicapped or undergoing physical rehabilitation and the like.

The apparatus and methods of the invention will be understood and appreciated further from the following description in connection with the drawings. Other systems, methods, features, and advantages of the present invention will be or become apparent to one with skill in the art upon examination of the following drawings and detailed description. It is intended that all such additional systems, methods, features, and advantages be included within this description, be within the scope of the present invention.

SUMMARY

The exercise apparatuses are lightweight and portable exercise devices for general physical fitness and exercise. Embodiments of exercise devices of the present invention utilize bodyweight resistance to assist in performance of exercises to develop muscle endurance, strength and reduce body fat. Such devices assist in exercising a variety of muscles from hips to shoulders. Overall, the device helps to control movements, transfer energy, shift body weight and move in any direction with ease to assist in performance of exercises, including, but not limited to pushups, pull-ups, dips and squats. It will be appreciated that the method and exercise apparatus of the invention can be used with a minimum of instruction to yield a maximum of controlled exercise. Operation of the apparatus is intuitive and automatic. Having selected appropriate tension elements, the user simply inserts a limb extremity into the apparatus, rests the limb upon a support and secures the limb extremity to a suspended pad. Thereafter, as the user's muscles are strained to move, the apparatus automatically opposes each movement commensurate with the strain in accordance with the force and direction of the strain.

In general the exercise apparatuses comprises a hinged A-shaped frame, seating means, a pulley system elastic resistance bands or cords (tension elements) secured at each end to an anchor device. The resistance imparted by the elastic bands or cords can be easily varied by engaging or disengaging individual resistance bands or lengthening or shortening individual bands. A list of suitable resistance bands includes but is not limited to, springs, springs with rubber coverings, elastic cords, resilient cords, "bungee" cords, Thera-Band® tubing and the like. Certain embodiments also comprise movable gripping means in the form of handles, handgrips and the like, which are attachable to and removable from the ends of the elastic resistance band(s) by the rings, hooks, ball-collar attachments etc. to secure such gripping means to the ends of the elastic. The devices are versatile enough to allow the user to employ a wide range of different type handles in order to achieve the desired exercise effect. The exercise apparatuses can be used to exercise all areas of the spine as well as every major extremity joint from shoulders, elbows, and wrists to hips, knees and ankles without the need for rotating to different machines to exercise different body parts.

The exercise devices of the present invention include devices employing a plurality of elongate elastic tension means such as elastic cables to provide a restoring force and a gripping means removedly attachable to any of the plurality of elongate elastic tension means. The elastic elongate elastic tension means are also selectively attachable to a retainer assembly to provide a wide range of variation in restoring force exerted against the gripping means. The plurality of elongate elastic tension means may also be enclosed in a flexible sheath to prevent the unattached, inactive elastic elongate elastic tension means from becoming entangled with each other or with the attached, active elastic elongate elastic tension means. A list of such elongate elastic tension means includes, but is not limited to, from the group consisting of elastic cables, elastic cords, coil springs, springs, springs with rubber coverings, resilient cords, bungee cords and combinations thereof.

Certain embodiments of the apparatus comprise multiple adjustable elastic bands as elastic elongate elastic tension means the ends of which are removedly attachable to the frame of the device wherein, the number and bands as well as the resistance of each band is varied by a user. The ends of the elastic bands extend through the pulleys (rollers) such that they are disposed on opposite sides of the pulley (roller) axes. The user may attach the required number of elastic bands for a particular exercise to the cushioned assistance seat (seating means). Padded handles are removedly or permanently attached to one end of each elastic band. Such handles allow for proper hand positioning and assist a user in performing various exercises. Handles are easy to grip and an overall padded design makes the unit both comfortable and durable. The apparatuses are also easy to pack-up, fold and store away.

A typical apparatus of the present invention comprises a four-legged foldable A-frame wherein first and second frame legs, each having a distal end and a proximal end, are each configured to be parallel and wherein third and fourth frame legs, each having a distal end and a proximal end, are also configured to be parallel to one another. The distal ends of the first and second legs are hingedly attached to the distal ends of the third and fourth legs by a hinge assembly, which may be any suitable hinge type, including, but not limited to, butt hinges, butterfly hinges, barrel hinges, pivot hinges and the like.

In certain embodiments the proximal ends of the first and second legs are fixedly attached to a first frame base, while the proximal ends of the third and fourth legs are attached to a second frame base. In certain embodiments a first gripping means such as a handle is affixed to each distal end of the first and second legs. In such embodiments the first and second legs the legs are comprises of tubes wherein at least one of the tubes has a multiplicity of perforations extending completely through the wall of the tube and configured along the longitudinal axis. At least one proximal end pulley is disposed at the proximal end of the first leg and at least one proximal end pulley is dispose at the proximal end of the second leg. In certain embodiments a multiplicity of proximal coaxial pulleys are disposed at or near the proximal ends of each of the first and second legs. In certain embodiments the position of the multiplicity of proximal coaxial pulleys can be varied along the longitudinal axes of the first and/or second legs.

In certain embodiments the proximal coaxial pulleys are slidebly coupled to the frame leg can be secured in a desired position by a locking mechanism including, but not limited to, a set screw, bolt, friction mechanism and the like.

In certain embodiments one or more distal coaxial pulleys are disposed at or near the distal end of the first leg and one or more distal coaxial pulleys are disposed at or near the distal end of the second leg. In certain embodiments a multiplicity of distal coaxial pulleys are disposed at the distal ends of each of the first and second legs.

In certain embodiments at least one elastic cord having a distal end and a proximal end is disposed along the longitudinal axis of the first legs and at least one elastic cord having a distal end and a proximal end is disposed along the longitudinal axis of the second leg, wherein the proximal end of the elastic cord is removedly attached at a location along the first leg, such that the elastic cord extends downward through a first leg proximal coaxial pulley; then upward along the longitudinal axis of the first leg, through a third leg distal coaxial pulley and then downward wherein the distal end of the cord is removedly attached to a crossbar disposed between the third and fourth legs, wherein the ends of the crossbar are slidably coupled to the third and fourth frame legs such that the crossbar remains parallel to the plane of the base (and perpendicular to the third and fourth frame legs) while being slidably moveable along the longitudinal axes of the third and fourth frame legs. In certain embodiments the proximal end of the elastic cord is removedly attached at or near the distal end of the first frame leg. In certain embodiments the crossbar comprises one or more seating means rotatably and adjustably attached thereto such that the weight of a user seated upon the seating means effects the depression of the crossbar thereby stretching and imparting tension to the elastic cords attached to the crossbar. In certain other embodiments the seating means has the form of a single seat, which may be padded. In all of the various embodiments of the apparatus the elastic cords can be individually coupled to or detached from the frame such that the overall tension (resistance) of the apparatus can be easily varied to accommodate a variety of exercises and be customized according to the needs of the user. In certain embodiments the collar shaped elastic cord distal end retaining members can be moved and fixed at various positions along the longitudinal axes of the first and second frame legs such that the distal ends of the elastic cord terminated with a ball retaining members can be secured in a variety of positions along the longitudinal axes of the first and second frame legs, thereby further providing a means of varying the resistance experienced by a user. Also certain embodiments the position along the longitudinal axes of the proximal coaxial pulley assemblies of the first and second frame legs can be varied in by adjustment of collars slidably coupled to the frame legs. Since such an adjustment changes the effective the length, and therefore the tension, of the elastic cords such an adjustment provides yet another means for varying the resistance experienced by a user when performing various exercises.

I certain embodiments gripping means in the form of adjustable L-handgrips are rotatably disposed at the distal ends of the third frame leg and fourth frame leg respectively. In preferred embodiments such L-handgrips have 360° rotating adjustability. In certain embodiments adjustable L-handgrips are attached to the ends of leg tubular members that are telescopically coupled within tubular frame legs. By such an arrangement the positions of adjustable L-handgrips can be slidably adjusted along the longitudinal axes of the tubular frame leg according to the needs of a user. In preferred embodiments the adjustable L-handgrips can be fixed in position by any of a variety of locking means including, but not limited to, set screws, bolts, collars, friction mechanism and the like.

In certain embodiments of the apparatus comprises a seat rotatably coupled to a crossbar or seat rod assembly, wherein the ends of the seat rod assembly are slidably coupled to the third and fourth legs such that the seat can move along at least a portion of the third and fourth legs. Such an embodiment can also comprises a movable and lockable collars that function as seat rod stops, which can be positioned along the length of the third and fourth legs to limit the travel of the crossbar or seat rod assembly. In such embodiments the ends of the seat rod extend through the third and fourth legs to function as an axle such that the seat assembly is rotatable about the crossbar or seat rod assembly and wherein the ends of the crossbar or seat rod assembly are configured to retain the distal ends of the elastic bands, which comprise suitable retention means at the distal termini. Such elastic cord retention means can be selected from, but are not limited to, flanges, balls, hooks and the like. The detachable elastic cord retention means gripping means can be any of a variety of handles, straps and the like. In certain preferred embodiments the elastic cord retention means are in the form of hook-like flanges.

In certain preferred embodiments the foldable A-frame can be secured in either an open (operational) or closed (folded) position. In certain embodiments the first and second legs are in the form of rectangular tubes each having a frontal surface, a rear surface and two side surfaces. In such embodiments all or part of the coaxial pulley systems are disposed within the interior of the tubular legs such that the major portion of the elastic cords are also disposed therein. The proximal coaxial pulley systems are disposed within the proximal ends of each of the first and second legs each extend out partially through an opening in the frontal surfaces of the proximal ends of the first and second legs. In certain embodiments the distal coaxial pulley systems are disposed within the distal ends of each of the first and second legs and extend out partially through an opening in the frontal surfaces of the distal ends first and second legs.

Certain embodiments further comprise two hinged cross-member assemblies disposed between the distal ends of first and third legs and the second and fourth leg respectively. Such hinged cross-members function to maintain the A-frame in an open position. In certain embodiment the cross member hinge means snap into a desired position wherein the two sections of each cross member are disposed at a 180° angle such that the two cross member assemblies are coplanar. In certain embodiments when the apparatus is in the operation configuration, the angular relationship between the first and third frame legs and the second and fourth frame legs is between 30° and 120°, preferably between 45° and 90° and most preferably between 55° and 75°.

In certain embodiments of the apparatus the number of coaxial pulleys and/or elastic cords on each of the first and second frame legs and the third and fourth frame legs is at least three; and wherein the number of elastic cords is. In certain embodiments the diameter of the individual elastics cords is a variable such that the larger the cord diameter the greater the tension of the cord at a give extension. Such embodiments allow greater variation of tension than do embodiments wherein all cords are of the same diameter.

In certain other embodiments a plurality of elastic cord distal end retaining members are distributed at along the frontal surfaces of the distal ends first and second frame legs such that the distal ends of the elastic cord terminated with a spherical member that is larger in diameter than the cord to which it is attached can be secured in a variety of positions along the longitudinal axes of the first and second frame legs by engaging within an elastic cord distal end retaining member, thereby further providing a facile means of varying the resistance experienced by a user.

In certain embodiments such elastic cord distal end retaining members comprise one or more U-shaped collars having diameters equal to or larger than the diameters of the elastic cords inserted therein, but smaller than the diameters of the spherical member disposed at the distal ends of the elastic cords such that the distal ends of elastic cords are retained when disposed within such U-shaped collars. In certain preferred embodiments such elastic cord distal end retaining members are slidebly coupled to a frame leg and can be secured in a desired position by a locking mechanism including, but not limited to, a set screw, bolt, friction mechanism and the like.

In certain embodiments the ends of crossbar comprise crossbar locks and the can be slidably positioned along the longitudinal axes of the frame legs and respectively legs to limit the travel of the crossbar. By this arrangement the crossbar functions as an axle such that the dual-component seats are rotatable about the rod and wherein the ends of the seat rods are configured to retain the distal ends of the elastic bands, which comprise suitable retention means at the distal termini. The elastic cord retention means can be selected from, but are not limited to, balls, hooks and the like. The detachable elastic cord retention means gripping means can be any of a variety of handles, straps and the like. In certain preferred embodiments the elastic cord retention means are in the form of hooks.

A variety of exercises can be performed with apparatuses of the present invention. Such exercises include, but are not limited to push-ups, pull-ups, lateral muscle pulls, squats, lunges, dips, hamstrings strengthening, bicep strengthening, and deltoid strengthening.

Other modifications, methods, features, and advantages of the present invention will be or become apparent to one with skill in the art upon examination of the above drawings and description. It is intended that all such additional systems, methods, features, and advantages be included within this description, be within the scope of the present invention.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention.

FIG. 10 is a perspective view of a portion of the exercise apparatus of FIG. 11 illustrating the adjustable L-handgrips in a raised position.

DESCRIPTION OF THE INVENTION

Figure 1:
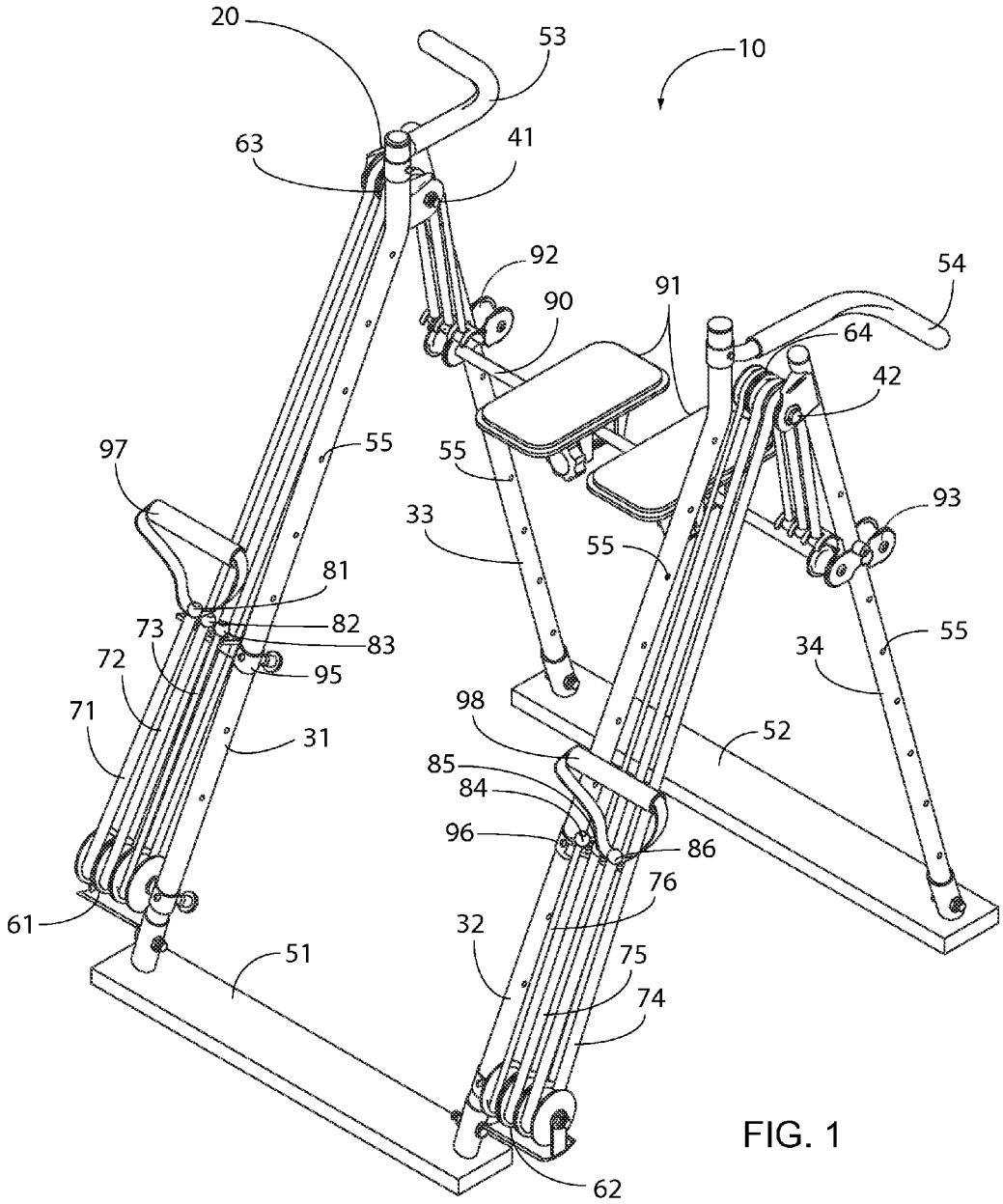
FIG. 1 is a perspective view of an embodiment of an exercise apparatus of the present invention.
Figure 2:
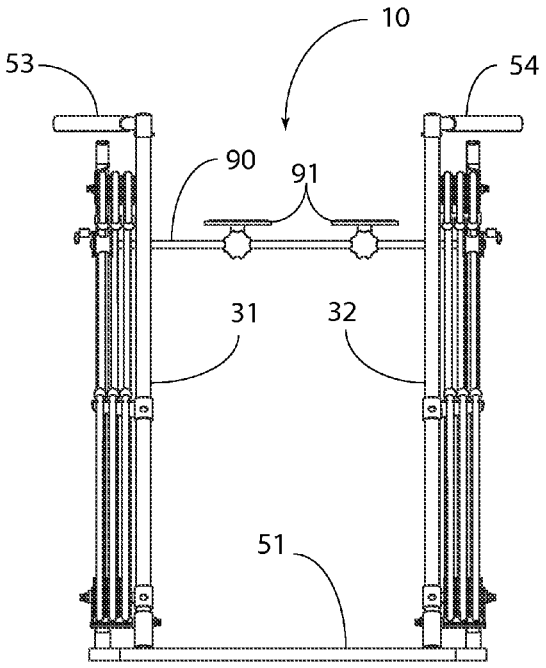
FIG. 2 is an orthographic frontal view of the exercise apparatus of FIG. 1.
Figure 3:
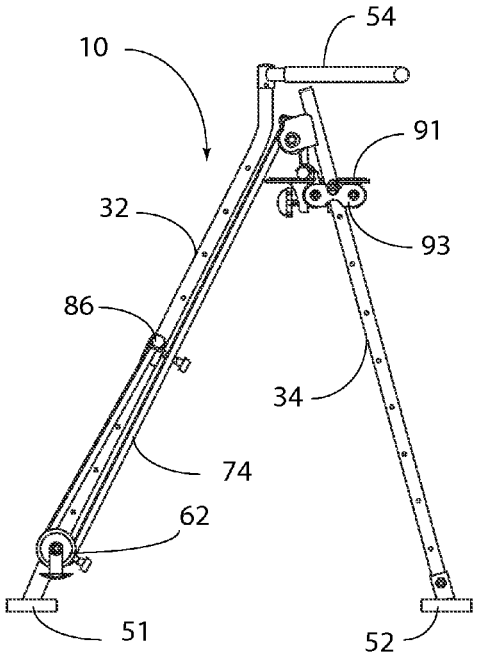
FIG. 3 is an orthographic side view of the exercise apparatus of FIG. 1.
Figure 4:
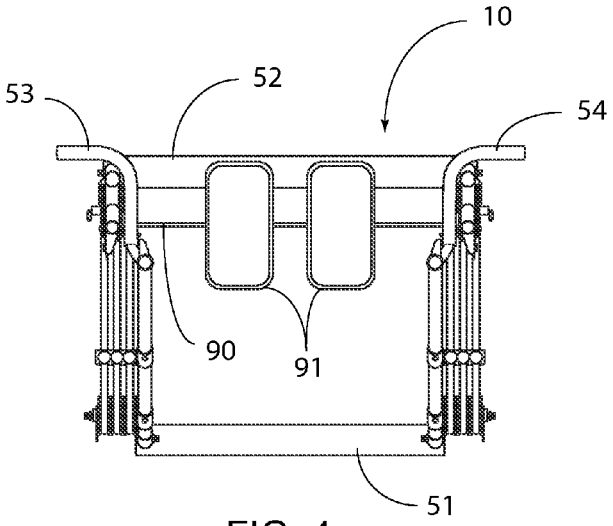
FIG. 4 is an orthographic top view of the exercise apparatus of FIG. 1.
Figure 5:
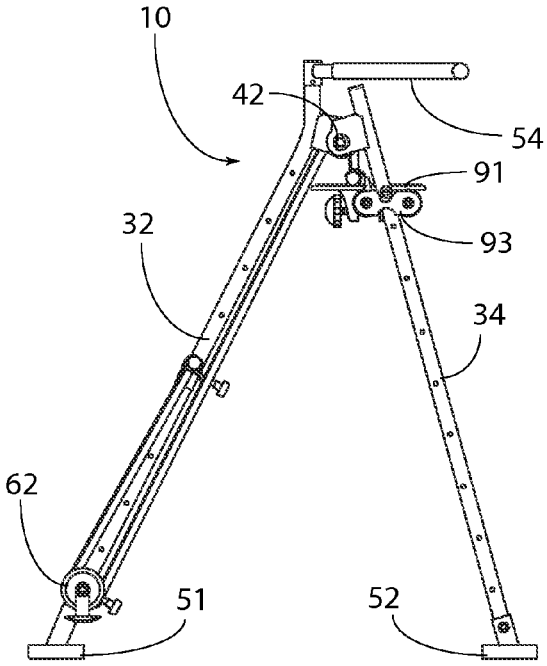
FIG. 5 is an orthographic side view of the exercise apparatus of FIG. 1 in an open in use position.

A typical exercise apparatus of the present invention comprises a frame comprising a first A-shaped component comprising two first A-shaped component frame legs each having a distal end and a proximal end, wherein the first A-shaped component frame legs are hingedly attached at the distal ends thereby defining a first A-shaped component apex and a second A-shaped component comprising two first A-shaped component frame legs each having a distal end and a proximal end, wherein the second A-shaped component frame legs are hingedly attached at the distal ends thereby defining a second A-shaped component apex. Such an apparatus also comprises a crossbar having a first crossbar end and a second crossbar end wherein the crossbar is disposed between the first A-shaped component and the second A-shaped component wherein the first crossbar end is slidably attached to a first A-shaped component frame leg and the second crossbar end is slidably attached to a second A-shaped component frame leg. Such an apparatus also comprises one or more pulley systems attached to at least one A-shaped component frame leg, wherein the pulley system comprises one or more elongate elastic tension means having a proximal end removedly attachable to a frame leg and a distal end removedly attachable to the crossbar. Further, such an apparatus comprises a seating means attached to the crossbar such that the weight of a user seated upon the seating means effects the depression of the crossbar thereby stretching and imparting tension to the elastic tension means attached to the crossbar. In certain embodiments of the apparatus the seating means is rotatably attached to the cross bar and is lockable.

In certain embodiments of the apparatus the resistance imparted by the elastic tension means can be varied by engaging or disengaging individual elastic tension means or by lengthening or shortening individual elastic tension means. In certain other embodiments of the apparatus the proximal end of at least one of the two frame legs of each A-shaped component is attached to a base wherein the crossbar is configured to remain parallel to the plane of the base.

In certain embodiments the apparatus further comprising elastic tension means handles removedly attachable to the one or more of the elastic tension means proximal ends. In certain embodiments the apparatus comprises a first L-shaped gripping means rotatably attached at the first A-shaped component apex and a second L-shaped gripping means rotatably attached at the second A-shaped component apex.

In certain embodiments of the apparatus at least one of the first A-shaped component frame legs comprises a first telescoping tube and at least one of the second A-shaped component frame legs comprises a second telescoping tube. While in certain other embodiments the first L-shaped gripping means is attached to the distal end of the first telescoping tube and wherein the second L-shaped gripping means is attached to is attached to the distal end of the second telescoping tube and wherein at least one of the first telescoping tube and second telescoping tube comprises a locking means for setting the telescoping tube to any desired length. In certain embodiments of the apparatus the a L-shaped gripping means is attached to the distal end of a first telescoping tube and a second L-shaped gripping means is attached to the distal end of a second telescoping tube and wherein at least one of the first telescoping tube and second telescoping tube comprises a locking means for setting the telescoping tube to any desired length.

In certain embodiments of the apparatus one or more of the pulley systems attached to one of the A-shaped component frame legs is at least partially disposed within that frame leg.

A typical apparatus 10 of the present invention as Illustrated in FIGS. 1-10 comprises a four-legged foldable A-frame 20 having a first frame leg 31 and second frame leg 32, each having a distal end and a proximal end, are each configured to be parallel, and third frame leg 33 and fourth frame leg 34, each having a distal end and a proximal end and configured to be parallel to one another. The distal ends of the first frame leg 31 and second frame leg 32 are hingedly attached to the distal ends of the third frame leg 33 and fourth frame leg 34 respectively by hinge assemblies 41 and 42. In this embodiment the proximal ends of the first frame leg 31 and second frame leg 32 are fixedly attached to a first frame base 51, while the proximal ends of the third frame leg 33 and fourth frame leg 34 are attached to a second frame base 52; and adjustable L-handgrips 53 and 54 are attached to the distal ends of the first frame leg 31 and second frame leg 32 to provide gripping means. In certain embodiments, such gripping means may be rotatably attached to the distal ends of the frame legs.

Figure 7:
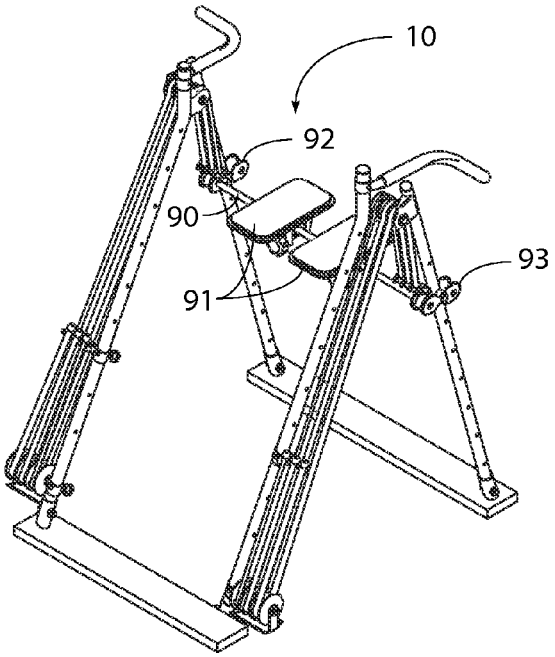
FIG. 7 is a perspective view of a portion of the exercise apparatus of FIG. 1 illustrating the adjustable seat in a raised configuration.
Figure 8:
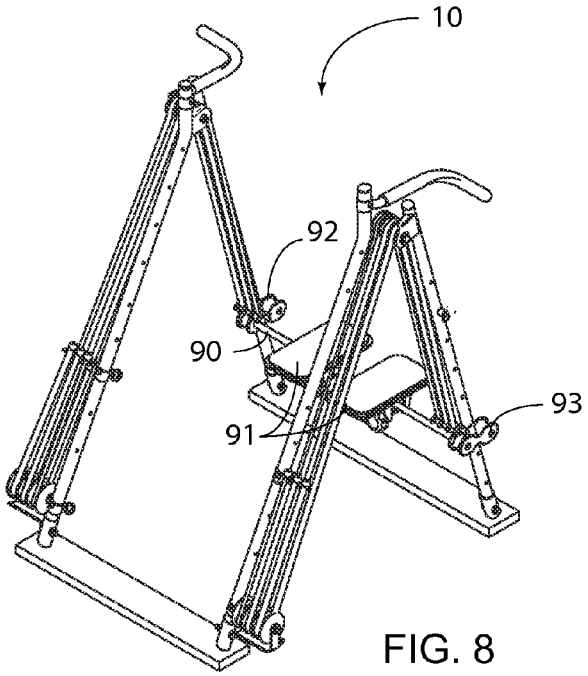
FIG. 8 is a perspective view of a portion of the exercise apparatus of FIG. 1 illustrating the adjustable seat in a lowered configuration.

In apparatus 10 the frame legs 31, 32, 33 and 34 are comprised of tubes having a multiplicity of perforations 55 extending completely through the walls of the tubes and configured along the longitudinal axes of the tubes. Three first frame leg proximal end coaxial pulleys 61 are disposed and slidably attached at the proximal end of the first frame leg 31 and three second frame leg proximal end coaxial pulleys 62 are dispose and slidably attached at the proximal end of the second frame leg 32. Three third frame leg distal end coaxial pulleys 63 are disposed at the distal end of the third frame leg 33 and fourth third frame leg distal end coaxial pulleys 64 are disposed at the distal end of the fourth frame leg 34. Three elastic cords 71, 72, and 73 each having a distal end and a proximal end are disposed along the longitudinal axis of the first frame leg 31 and three elastic cords 74, 75 and 76 each having a distal end and a proximal end are disposed along the longitudinal axis of the second frame leg 32, wherein the proximal ends of the elastic cords 71, 72 and 73 are removedly attached at a position along the longitudinal axis of the first frame leg 31, such that the elastic cords 71, 72 and 73 extend downward through first frame leg 31 coaxial pulleys 61; then upward along the longitudinal axis of the first frame leg 31, through the third frame leg 33 distal coaxial pulleys 63 and then downward wherein the distal ends of elastic cords 71, 72 and 73 are removedly attached to a crossbar 90 disposed between the third frame leg 33 and fourth frame leg 34, wherein the ends of the crossbar 90 are slidably coupled to the third frame leg 33 and fourth frame leg 34 by means of crossbar coupling rollers 92 and 93 respectively such that the crossbar remains parallel to the plane of the base 52 and perpendicular to the third frame leg 33 and fourth frame leg 34, while being slidably moveable along the longitudinal axes of the third frame leg 33 and fourth frame leg 34. Seating means in the form of two dual-component seats 91 are rotatably and adjustably attached to the crossbar 90 such that the weight of a user seated upon the dual-component seats 91 effects the depression of the crossbar 90 thereby stretching and imparting tension to the elastic cords attached to the crossbar 90. Additionally in the apparatus 10 of FIG. 1 the of position proximal end coaxial pulleys 61 and 62 along the longitudinal axes of the frame legs 31 and 32 to which they are respectively attached can be varied. FIGS. 7 and 8 illustrates such positional variance. In FIG. 7 crossbar 90 and the attached dual-component seats 91 are in a raised position, while in FIG. 8 crossbar 90 and the attached dual-component seats 91 are in a lowered position. In certain embodiments the seating means is rotatably attached to the cross bar.

Figure 10:
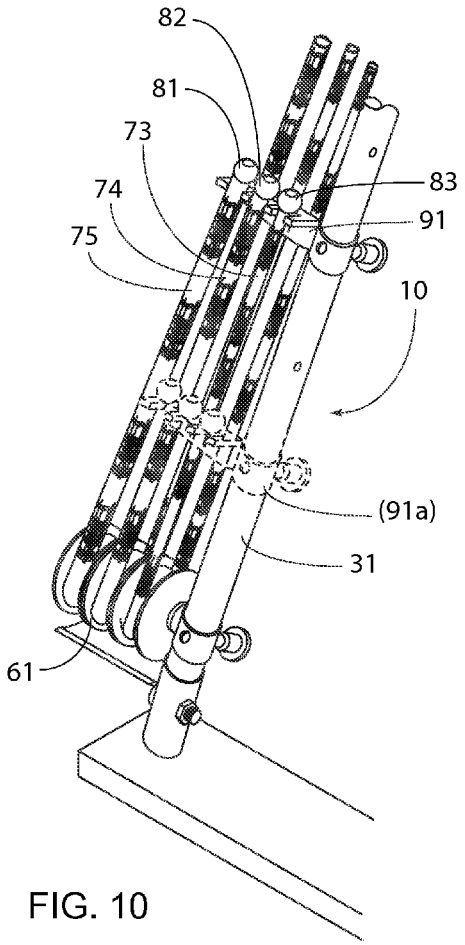

In all of the various embodiments of the apparatus the elastic cords can be individually coupled to or detached from the frame such that the overall tension (resistance) of the apparatus can be easily varied to accommodate a variety of exercises and be customized according to the needs of the user. In embodiments such as apparatus 10 as is clearly depicted in FIG. 10, to the distal ends of elastic cords 71, 72, 73, 74, 75 and 76 comprise spherical elements 81, 82, 83, 84, 85 and 86 respectively, wherein each spherical elements has a diameter larger in than that of the chord to which it is attached. Attached to the frame legs 31 and 32 are U-shaped elastic cords retaining elements 95 and 96 each comprising three U-shaped collars having diameters equal to or larger than the diameters of the elastic cords 71, 72, 73, 74, 75 and 76 inserted therein, but smaller than the diameters of the spherical elements 81, 82, 83, 84, 85 and 86, such that the distal ends of elastic cords 71, 72, 73, 74, 75 and 76 are retained when inserted therein. Additionally the attachment of the elastic cords retaining means 95 and 96 to the frame legs 31 and 32 is such that the positions of the retaining means 95 and 96 can be varied along the longitudinal axes of the frame legs 31 and 32 to which they are attached, such that the tension of the elastic cords 71, 72, 73, 74, 75 and 76 can be varied and adjusted. FIG. 10 illustrates such positional variance of the elastic chord retaining element 91 along the longitudinal axis of frame leg 31, wherein an upper position is depicted and a lower position is depicted in phantom by dashed lines and is denoted as (91*a*). FIG. 1 also illustrates the apparatus 10 having handgrips 97 and 98, which are removedly attached to the distal ends of elastics chords 71 and 74 respectively.

Figure 9:
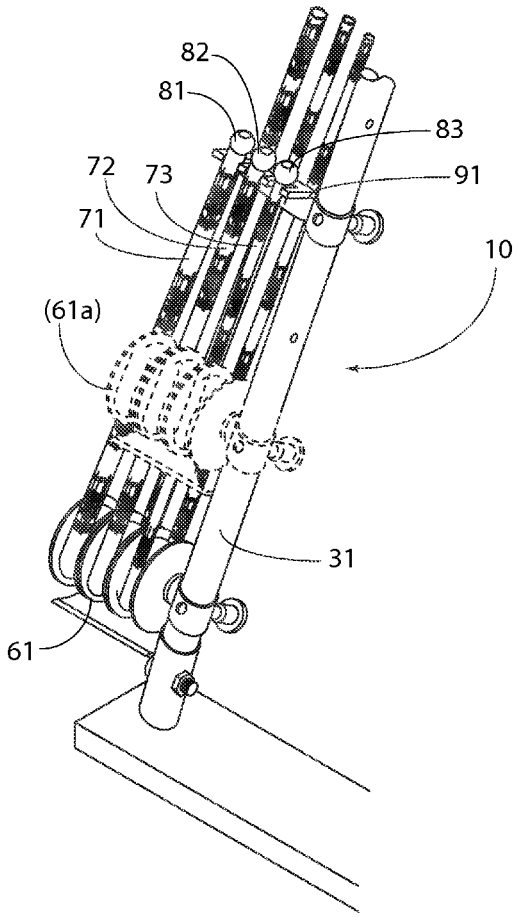
FIGS. 9 and 10 are perspective views of a portion of the exercise apparatus of FIG. 1 illustrating the two possible positions of the pulley system as a method of varying resistance.

Additionally in the apparatus 10 of FIG. 1 the of position proximal end coaxial pulleys 61 and 62 along the longitudinal axes of the frame legs 31 and 32 to which they are respectively attached can be varied. FIG. 9 illustrates such positional variance of the elastic chord retaining coaxial pulleys 61 along the longitudinal axis of frame leg 31, wherein coaxial pulleys 61 are in a lower position is depicted and wherein coaxial pulleys 61 in a raised position is depicted in phantom by dashed lines and denoted as (61*a*). Since such an adjustment changes the effective the length, and therefore the tension, of the elastic cords 71, 72, 73, 74, 75 and 76; this adjustment provides yet another means for varying the resistance experienced by a user when performing various exercises.

Figure 6:
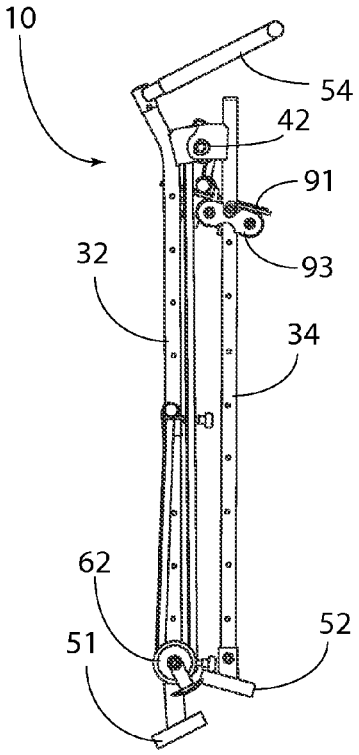
FIG. 6 is an orthographic side view of the exercise apparatus of FIG. 1 in a closed storage position.

In certain preferred embodiments the foldable A-frame can be secured in either an open operational or folded storage position. FIGS. 1-5 depict the apparatus 10 in the open operational position, while FIG. 6 depicts apparatus 10 in folded storage position.

Another embodiment of the present invention is the exercise apparatus 100 as illustrated in FIGS. 11-20. The apparatus 100 comprises a four-legged foldable A-frame 110 having a first frame leg 115 and second frame leg 116, each in the form of a rectangular tube having a frontal surface 121, a rear surface 122 (not visible in FIGS.), and two side surfaces 123, wherein each frame leg has a distal end and a proximal end; and wherein first frame leg 115 and second frame leg 116 are configured to be parallel to one another. The A-frame 110 also comprises a third frame leg 131 and fourth frame leg 132, each having a distal end and a proximal end; and wherein first frame leg 131 and second frame leg 132 are configured to be parallel to one another. In apparatus 100 the frame legs 131 and 132 are comprised of circular tubes. The distal ends of the first frame leg 115 and second frame leg 116 are hingedly attached to the distal ends of the third frame leg 131 and fourth frame leg 132 respectively.

The embodiment of the apparatus 100 further comprises two hinged cross-member assemblies 138 and 139 disposed between the proximal ends of first frame leg 115 and third frame leg 131 and the second frame leg 116 and fourth frame leg 132 respectively; wherein the hinged cross-member assemblies each have two hingedly connected sections as clearly shown in FIGS. 11, 13, 15, 16, 17 and 18. Such hinged cross-members function to maintain the A-frame in an open position. Additionally in the embodiment of the apparatus 100 the hinged cross-member assemblies 138 and 139 include locking components 138*a* and 139*a* respectively, wherein such a locking means functions to snap into a locking position wherein the two sections of each hinged cross member are disposed at a 180° angle such that the cross-member assemblies 138 and 139 are coplanar.

Additionally in the apparatus 100 the proximal ends of the first frame leg 115 and the second frame leg 116 are fixedly attached to a first frame base 135 disposed there between. Adjustable L-handgrips 136 and 137 are rotatably disposed at the distal ends of the third frame leg 131 and fourth frame leg 132 respectively to provide gripping means. The rotating functionality of adjustable L-handgrips 136 and 137 is clearly illustrated in FIG. 20 wherein forward positions of adjustable L-handgrips 136 and 137 are depicted and backward position adjustable L-handgrips 136 and 137 are depicted in phantom by dashed lines and are denoted as (136*a*) and (137*a*).

Figure 19:
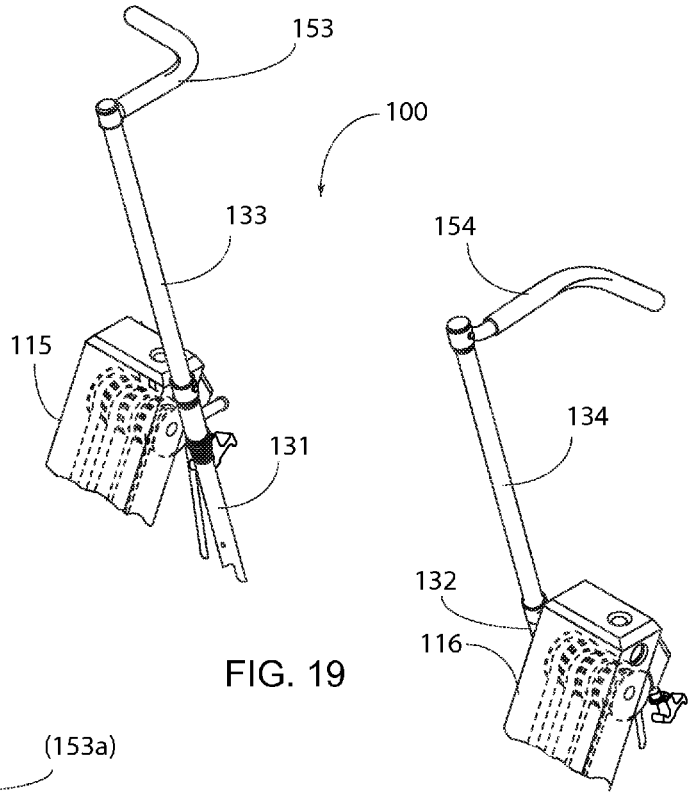
Figure 20:
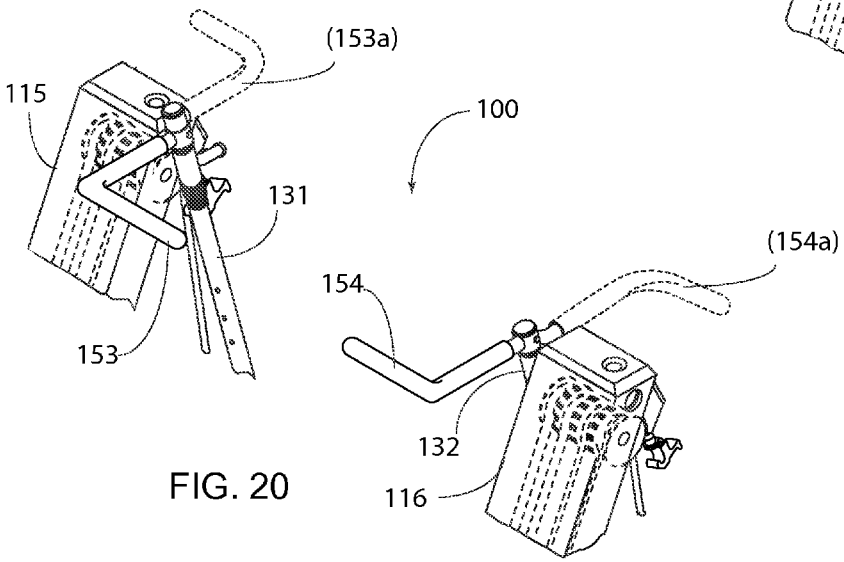
FIG. 20 is a perspective view of a portion of the exercise apparatus of FIG. 11 illustrating the adjustable L-handgrips in a lowered and rotated position.

As is illustrated in FIGS. 19 and 20, in the apparatus 100 the adjustable L-handgrips 136 and 137 are attached to the ends of frame leg tubular members 133 and 134 respectively, which are telescopically couple to frame legs 131 and 132 respectively. By such an arrangement the positions of adjustable L-handgrips 136 and 137 can be slidably adjusted along the longitudinal axes of the frame leg tubular members 133 and 134 according to the needs of a user. FIG. 19 depicts the adjustable L-handgrips 136 and 137 lengthened positions, while FIG. 20 depicts the adjustable L-handgrips 136 and 137 in shortened positions.

Three proximal end coaxial pulleys 141*a* are disposed at the proximal end of the first frame leg 115 and three proximal end coaxial pulleys 141*b* are disposed at the proximal end of the second frame leg 116 and three distal end coaxial pulleys 142*a* are disposed at each of the distal end of the first frame leg 115 and three distal end coaxial pulleys 142*b* are disposed at each of the distal end of the second frame leg 116.

Four elastic cords 151*a*, 152*a*, 153*a* and 154*a* each having a distal end and a proximal end are disposed along the longitudinal axis of the first frame leg 115 and three elastic cords

151*b*, 152*b* 153*b* and 154*b* each having a distal end and a proximal end are disposed along the longitudinal axis of the second frame leg 116. The proximal ends of the elastic cords 151*a*-154*a* and 151*b*-154*b* each comprise a spherical element 155 having a diameter greater in than that of the chord to which it is attached. By means of the spherical elements 155 the elastic cords 151*a*-154*a* and 151*b*-154*b* are removedly attachable to a plurality of U-shaped collars 156 disposed at positions along the longitudinal axis of the frame legs 115 and 116. By means of the spherical elements 155 and the U-shaped collars 156 the elastic cords 151*a*-154*a* and 151*b*-154*b* are attached to frame legs 115 and 116, wherein the elastic cords 151*a*-154*a* and 151*b*-154*b* then extend downward through coaxial pulleys 141*a* and coaxial pulleys 141*b* respectively and then continue upward along the longitudinal axis of the frame legs 115 and 116 and through the coaxial pulleys 142*a* and 142*b* respectively. The distal ends of each of the elastic chords 151*a*-154*a* and 151*b*-154*b* comprise an attachment element in the form of a flange 166 configured to be removedly attachable to the crossbar 161, wherein the flange functions as a hook. The crossbar 161 is disposed between the third frame leg 131 and fourth frame leg 132, wherein the ends of the crossbar 161 are slidably coupled to the third frame leg 131 and fourth frame leg 132 respectively such that the crossbar 161 remains parallel to the plane of the base 135 and perpendicular to the third frame leg 131 and fourth frame leg 132, while being slidably moveable along the longitudinal axes of the third frame leg 131 and fourth frame leg 132.

Figure 11:
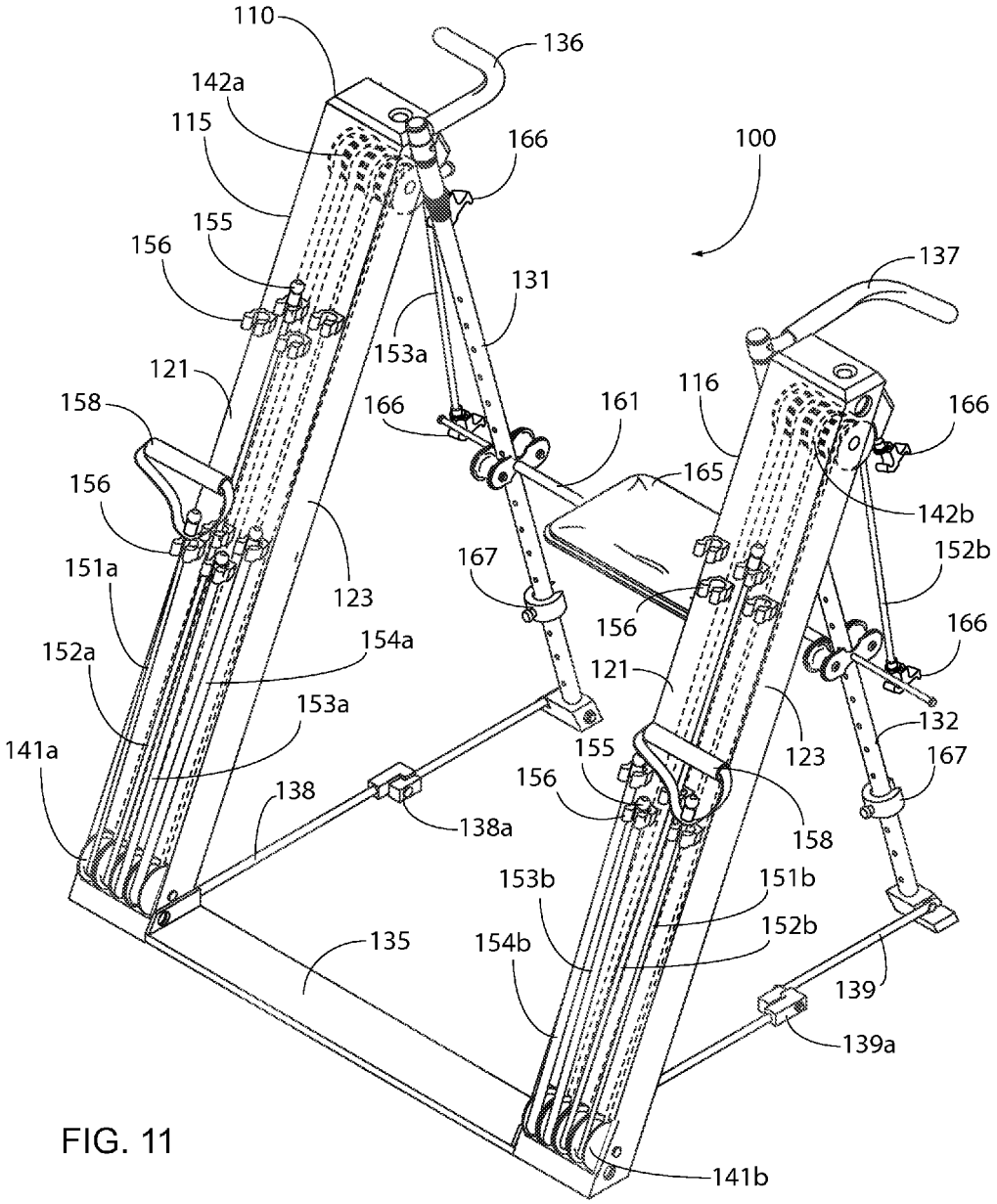
FIG. 11 is a perspective view of another embodiment of an exercise apparatus of the present invention.
Figure 12:
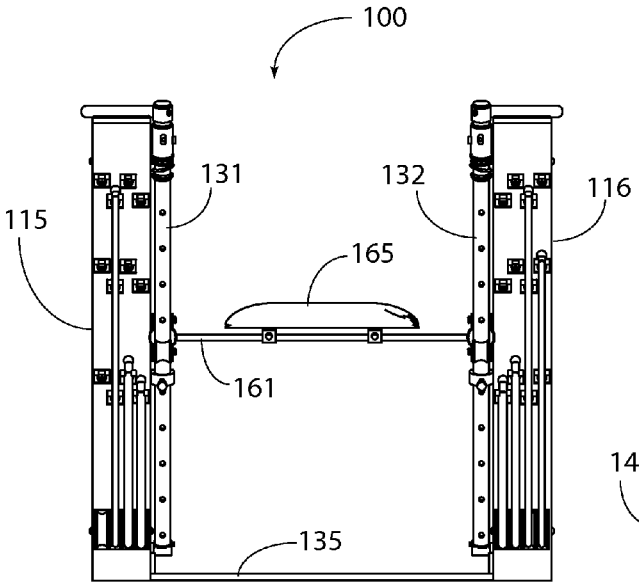
FIG. 12 is an orthographic frontal view of the exercise apparatus of FIG. 11.
Figure 13:
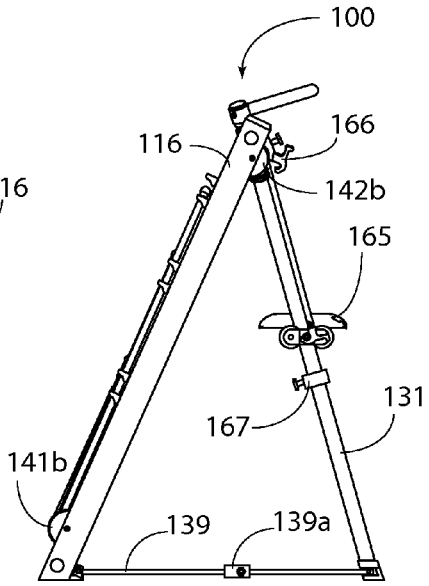
FIG. 13 is an orthographic side view of the exercise apparatus of FIG. 11.
Figure 14:
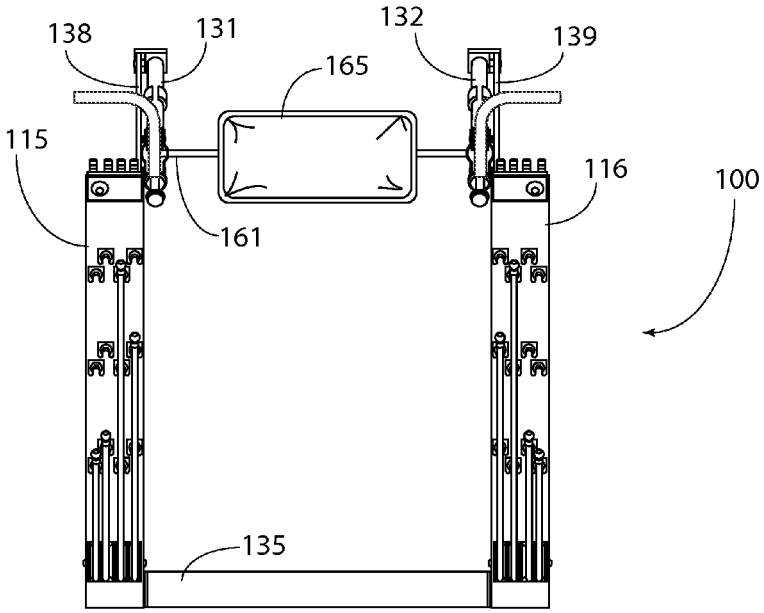
FIG. 14 is an orthographic top view of the exercise apparatus of FIG. 11.
Figure 17:
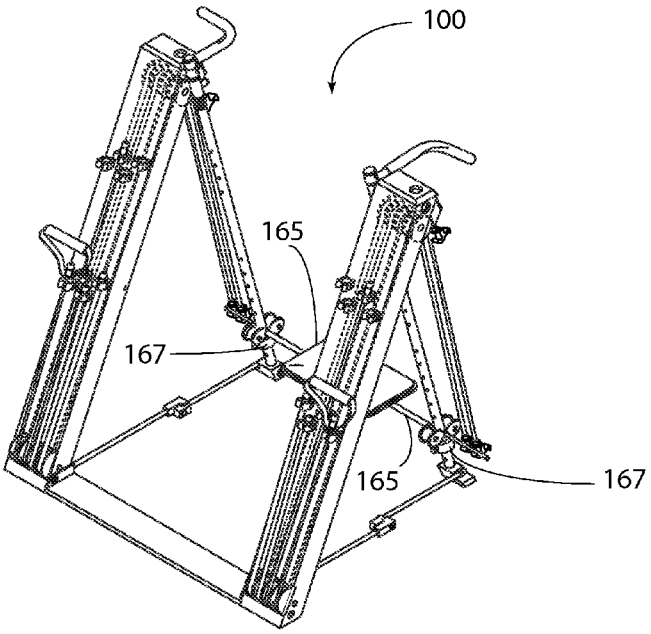
FIG. 17 is a perspective view of a portion of the exercise apparatus of FIG. 11 illustrating the adjustable seat in a lowered configuration.
Figure 18:
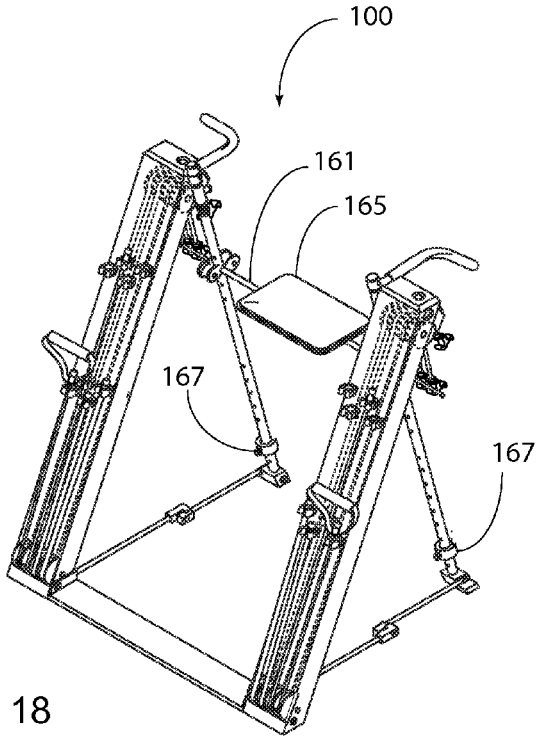
FIG. 18 is a perspective view of a portion of the exercise apparatus of FIG. 11 illustrating the adjustable seat in a raised configuration.

In FIG. 11 the flanges 166 at the distal ends of elastic cords 153*a* and 152*b* are shown attached to crossbar 166, while the flanges 166 at the distal ends of elastic cords 154*a* and 151*b* are depicted as unattached. Additionally a lockable collar 168 is disposed about each of the frame legs 131 and 132 disposed beneath the crossbar 161, wherein the lockable collars 168 functioning to limit the downward movement of the crossbar 161. Seating means in the form of a seat 165 is rotatably and adjustably attached to the crossbar 161 such that the weight of a user seated upon the seat 165 effects the depression of the crossbar 161 thereby stretching and imparting tension to any of the elastic cords attached to the crossbar 161, wherein the depression of the crossbar 66 is limited by the position of the lockable collars 168 chosen by a user of the apparatus 100. FIG. 17 depicts the seat 165 and crossbar 161 of apparatus 100 in a raised position and FIG. 18 depicts the seat 165 and crossbar 161 of apparatus 100 in a lowered position.

FIG. 11 also illustrates an embodiment of the apparatus 100 having two handgrips 158, which are removedly attached to the distal ends of a one or more of the elastics chords 151*a*, 152*a*, 153*a*, 154*a*, 151*b*, 152*b*, 153*b* and 154*b*.

Figure 15:
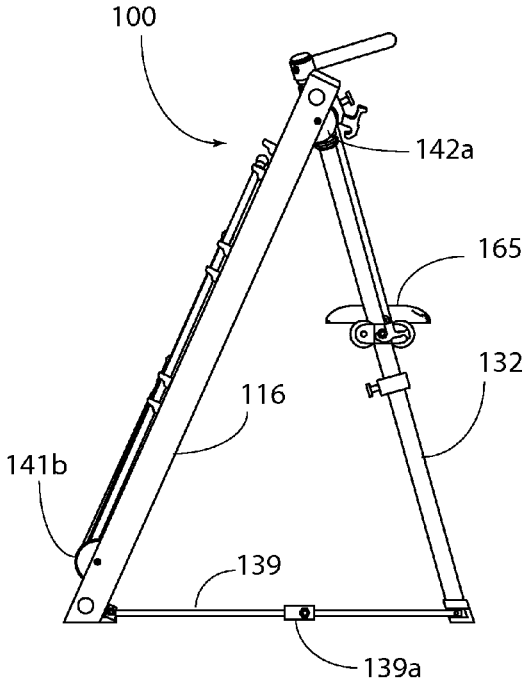
FIG. 15 is an orthographic side view of the exercise apparatus of FIG. 11 in an open in use position.
Figure 16:
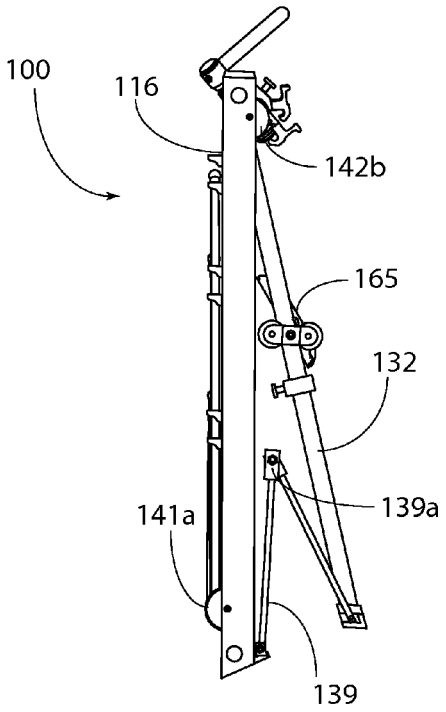
FIG. 16 is an orthographic side view of the exercise apparatus of FIG. 11 in a closed storage position.

The apparatus 100 can be retained an open position as illustrated in FIG. 15 or a closed position as illustrated in FIG. 16.

In apparatus 100 the proximal coaxial pulley systems 141*a* and 141*b* are disposed within the proximal ends of each of the first and second legs 155 and 116 respectively and each extends out partially through an opening in the frontal surfaces 121 of the proximal ends of the first and second legs as shown clearly in FIGS. 11,13 and 15-18. The distal coaxial pulley systems are disposed within the distal ends of each of the first and second legs and extend out partially through an opening in the frontal surfaces 121 of the distal ends first and second legs as shown clearly in FIGS. 11,13 and 15-20.

In embodiments such as the embodiment of FIG. 11 (clearly depicted in FIGS. 12 and 14) a multitude of collar shaped elastic cord distal end retaining members are distributed at along the frontal surfaces of the distal ends first and second frame legs such that the distal ends of the elastic cord terminated with a ball retaining members can be secured in a variety of positions along the longitudinal axes of the first and second frame legs, thereby further providing a facile means of varying the resistance experienced by a user.

A variety of exercises can be performed with apparatuses of the present invention. Such exercises include, but are not limited to push-ups, pull-ups, lateral muscle pulls, squats, lunges, dips, hamstrings strengthening, bicep strengthening, and deltoid strengthening.

Figure 21:
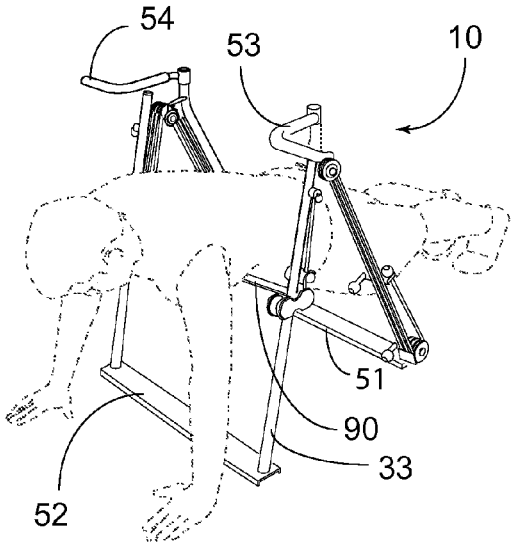
FIG. 21 is a perspective view of a user utilizing an exercise apparatus to perform a push-up exercise.

FIG. 21 illustrates a user in a traditional push-up position utilizing apparatus 10 to perform a push-up exercise, wherein the user's frontal midsection is disposed upon the seats 91 attached to crossbar 90, the users hands are disposed palms facing down in front of frame base 52 and the user's feet are disposed behind frame base 51 and the one or more of the various elastic cords are disposed in selected positions to provide the user's desired overall tension/resistance to the apparatus 10. The user then performs the exercise by alternately raising and lowering the body in the manner of a traditional push-up exercise by the use of the arms while maintaining the body and legs in an extended straightened position.

A method for performing a push-up exercise utilizing an apparatus of the present invention comprises the steps of: (1) disposing one or more of the elastic tension means in a selected position to provide a desired overall tension/resistance; (2) disposing the frontal midsection of the body upon the seating means; (3) disposing the hands with palms facing down in front of the frame while the feet are disposed behind frame and legs are straightened; and (4) alternately raising and lowering the body by the use of the arms while maintaining the body and legs in an extended straightened position.

Figure 22:
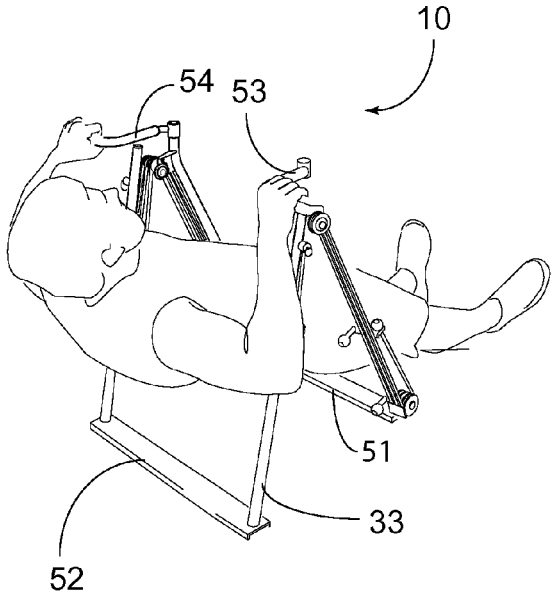
FIG. 22 is a perspective view of a user utilizing an exercise apparatus to perform a lateral pull exercise.

FIG. 22 is an illustration of a user utilizing exercise apparatus 10 to perform a lateral pull exercise, wherein the user's right hand is gripping L-handgrip 53, user's right hand is gripping L-handgrip 54, and user's back rests upon the seats 91 attached to crossbar 90. The heels of the user's feet are disposed on the floor area behind frame base 51 and the various elastic cords are disposed in selected positions to provide the user's desired overall tension/resistance to the apparatus 10.

A method for performing a lateral pull exercise utilizing an apparatus of the present invention comprises the steps of: (1) disposing one or more of the elastic tension means in a selected position to provide a desired overall tension/resistance; (2) gripping the L-shaped handgrips with the right and left hand respectively; (3) resting the lower back and/or buttocks upon the seating means with legs extended and feet disposed upon the surface outside of the frame; and (4) alternately raising and lowering the body by the use of the arms while maintaining the body and legs in an extended straightened position.

Figure 23:
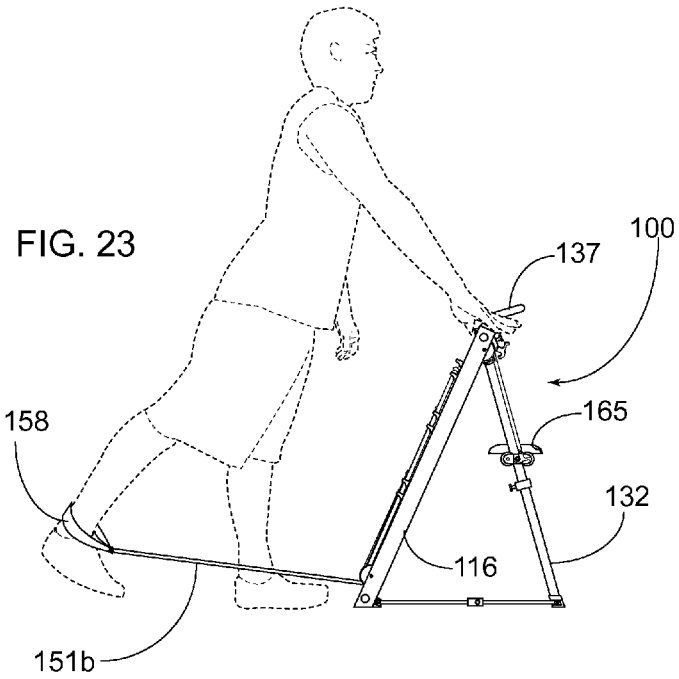
FIG. 23 is a perspective view of a user utilizing an exercise apparatus to perform a hamstring exercise.

FIG. 23 is an illustration of a user utilizing exercise apparatus 100 to perform a hamstring exercise, wherein the user's right ankle is disposed in handgrip 158, which is removedly attached to the distal end of a one of the elastics chord 151*b*, 152*b*, 153*b* 154*b*, wherein front of the user's body faces the apparatus 100 while the user moves the fight leg back (away from apparatus 100) while maintaining right leg in a straight position without bending the knee; and wherein and the elastic cords selected from elastics chord 151*b*, 152*b*, 153*b* 154*b* is disposed in selected a position to provide the user's desired overall tension/resistance to perform the exercise.

Figure 24:
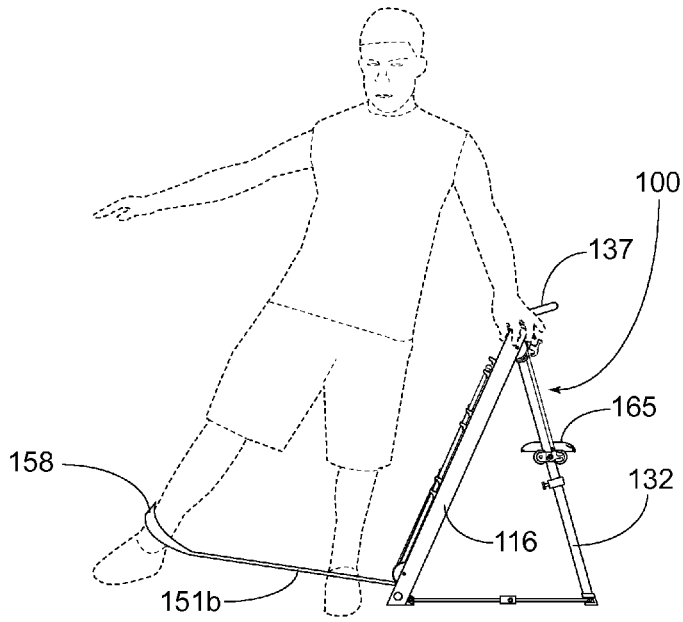
FIG. 24 is a perspective view of a user utilizing an exercise apparatus to perform a hip abductor exercise.

FIG. 24 is an illustration of a user utilizing exercise apparatus 100 to perform a hip abductor exercise, wherein the user's right ankle is disposed in handgrip 158, which is removedly attached to the distal end of the elastic chord 151*b*, wherein left side of the user's body faces the apparatus 100 while the user moves the right leg back (away from apparatus 100) while maintaining the right leg in a straight position without bending the knee; and wherein and the elastic cord elastics chord 151*b* is disposed in selected position to provide the user's desired overall tension/resistance to perform the exercise.

Figure 25:
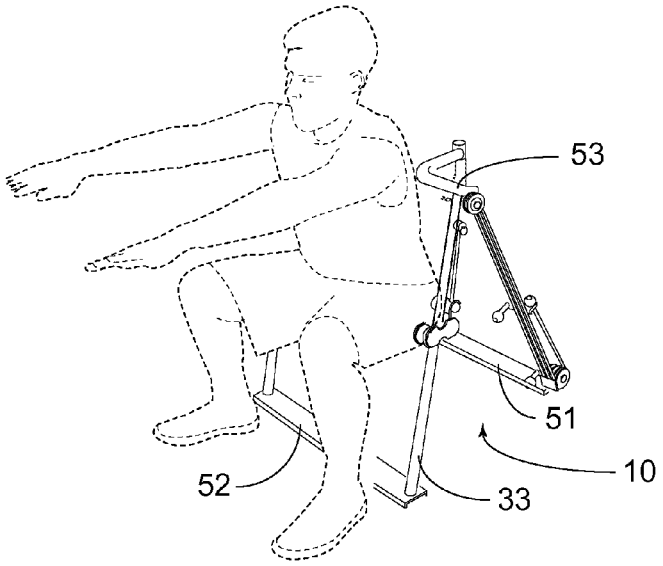
FIG. 25 is a perspective view of a user utilizing an exercise apparatus to perform a squat exercise.

FIG. 25 is an illustration of a user utilizing exercise apparatus 10 to perform a squat exercise, wherein the user is seated on seats 91, which are attached to crossbar 90 while the back if the user's body is adjacent to the apparatus 10 such that the user is face away from the apparatus 10; and wherein the one or more of the various elastic cords are disposed in selected positions to provide the user's desired overall tension/resistance to the apparatus 10. The user performs the exercise by squatting and rising with arms extended to the front of the body.

Figure 26:
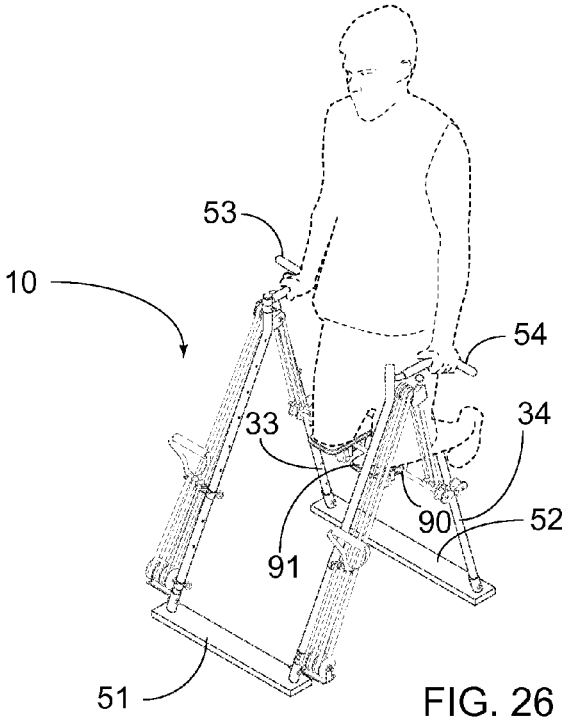
FIG. 26 is a perspective view of a user utilizing an exercise apparatus to perform a dip exercise.

FIG. 26 an illustration of a user utilizing an exercise apparatus 10 to perform a dip exercise, wherein user faces the apparatus 10 while user's knees are resting upon seats 91 and user holds L-handgrips 53 and 54 and wherein one or more of the various elastic cords are disposed in selected positions to provide the user's desired overall tension/resistance to the apparatus 10. The user performs the exercise by alternatively pulling up and pushing down with arm muscles.

Figure 27:
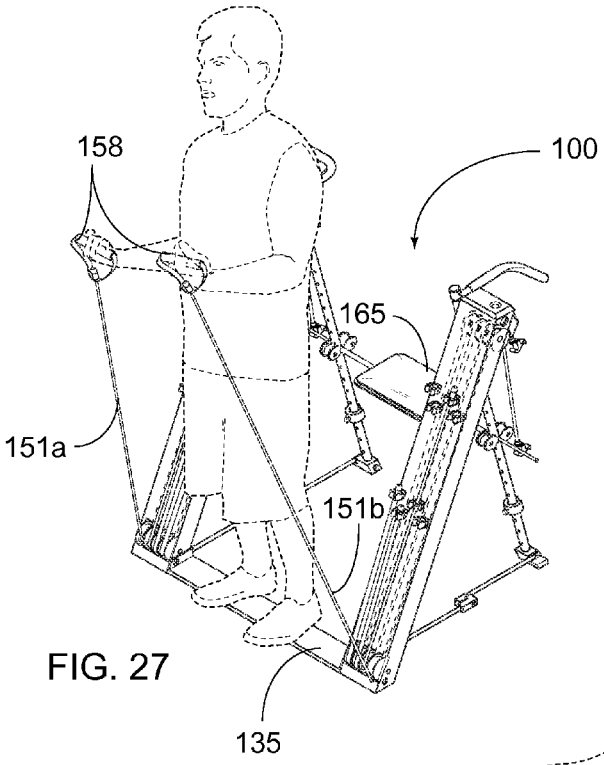
FIG. 27 is a perspective view of a user utilizing an exercise apparatus to perform a biceps exercise.

FIG. 27 an illustration of a user utilizing an exercise apparatus 100 to perform a biceps exercise, wherein the user stand upon frame base 135 facing away from the apparatus 100 and wherein the user's hands with palms upturned hold the handgrips 158, which are attached to elastic chords 151*a* and 151*b* respectively, and wherein the elastic cords 151*a* and 151*b* are disposed in selected positions to provide the user's desired overall tension/resistance while performing the exercise. The user performs the exercise by pulling the hands towards the chest by bending arms at the elbow while maintaining the upper arms in contact with the upper torso.

Figure 28:
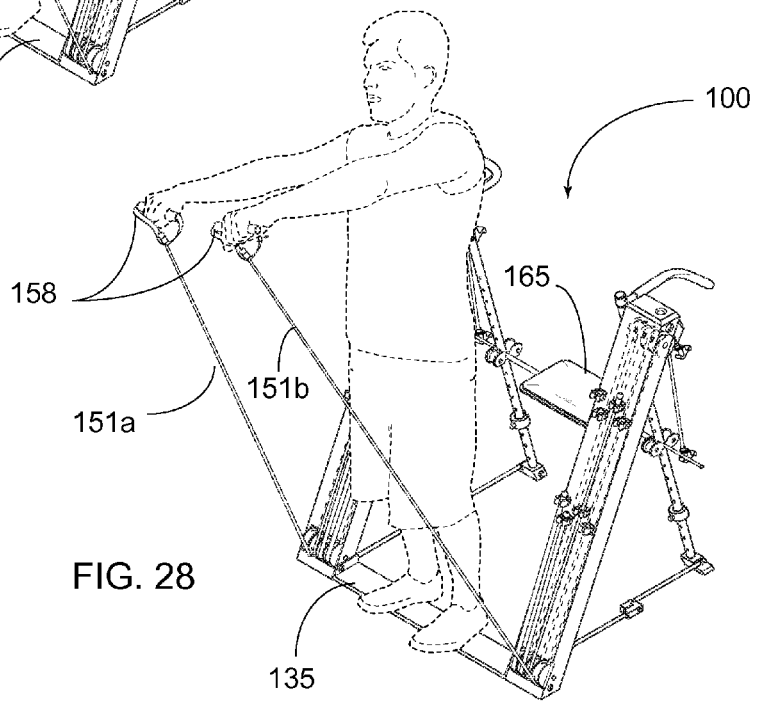
FIG. 28 is a perspective view of a user utilizing an exercise apparatus to perform a deltoid exercise.

FIG. 28 an illustration of a user utilizing an exercise apparatus 100 to perform a deltoid exercise, wherein the user stands erect upon frame base 135 while facing away from the apparatus 100 and wherein the user's hands with palms downturned hold the two handgrips 158, which are attached to elastic chords 151*a* and 151*b* respectively, and wherein the elastic cords 151*a* and 151*b* are disposed in selected positions to provide the user's desired overall tension/resistance while performing the exercise. The exercise is performed by the user maintaining the arms in a straightened position in front of the body while alternately lifting and lowering the arms.

Since various embodiments of the apparatus can actually assist a user who cannot sufficiently perform exercises without assistance, it is especially adaptable and useful to individuals who may be handicapped or undergoing physical rehabilitation and the like.

It is recognized that other modifications, methods, features, and advantages of the present invention will be or become apparent to one with skill in the art upon examination of the above drawings and description. It is intended that all such additional systems, methods, features, and advantages be included within this description, be within the scope of the present invention.

We claim:

1. An exercise apparatus comprising:

a frame comprising: a first A-shaped component comprising two first A-shaped component frame legs each having a distal end and a proximal end, wherein the first A-shaped component frame legs are hingedly attached at the distal ends thereby defining a first A-shaped component apex; and a second A-shaped component comprising two first second A-shaped component frame legs each having a distal end and a proximal end, wherein the second A-shaped component frame legs are hingedly attached at the distal ends thereby defining a second A-shaped component apex; wherein the proximal end of at least one of the two frame legs of each A-shaped component is attached to a base;

a crossbar having a first crossbar end and a second crossbar end wherein the crossbar is disposed between the first A-shaped component and the second A-shaped component wherein the first crossbar end is slidably attached to one of the two first A-shaped component frame legs and the second crossbar end is slidably attached to one of the two second A-shaped component frame legs;

one or more pulley systems attached to at least one A-shaped component frame leg, wherein the one or more pulley system comprise one or more elongate elastic tension means having a proximal end removably attachable to the at least one A-shaped component frame leg and a distal end removably attachable to the crossbar; and a seating means attached to the crossbar.

2. The apparatus of claim 1 wherein the resistance imparted by the one or more elongate elastic tension means can be varied by engaging or disengaging individual elastic tension means of the one or more elongate elastic tension means or by lengthening or shortening individual elastic tension means of the one or more elongate elastic tension means.

3. The apparatus of claim 1 wherein the one or more elongate elastic tension means are chosen from the group consisting of elastic cables, elastic cords, coil springs, springs, springs with rubber coverings, resilient cords, bungee cords and combinations thereof.

4. The apparatus of claim 1 wherein the crossbar is configured to remain parallel to the plane of the base.

5. The apparatus of claim 1 further comprising elongate elastic tension means handles removably attachable to the one or more elongate elastic tension means proximal ends.

6. The apparatus of claim 1 further comprising a first L-shaped gripping means rotatably attached at the first A-shaped component apex and a second L-shaped gripping means rotatably attached at the second A-shaped component apex.

7. The apparatus of claim 1 wherein at least one of the first A-shaped component frame legs comprises a first telescoping tube and at least one of the second A-shaped component frame legs comprises a second telescoping tube.

8. The apparatus of claim 7 wherein a first L-shaped gripping means is attached to the distal end of the first telescoping tube and wherein the a second L-shaped gripping means is attached to the distal end of the second telescoping tube and wherein at least one of the first telescoping tube and second telescoping tube comprises a locking means for setting the telescoping tube to any desired length.

9. The apparatus of claim 1 wherein the one or more pulley systems attached to the at least one A-shaped component frame leg is at least partially disposed within one of the at least one A-shaped component frame leg.

10. The apparatus of claim 1 wherein the seating means is rotatably attached to the cross bar.

11. The apparatus of claim 1 further comprising a first hinged cross-member disposed between the proximal ends of the first A-shaped component frame legs and a second hinged cross-member disposed between the proximal ends of the second A-shaped component frame legs, wherein each hinged cross-member comprises two straight sections joined by a hinge.

12. The apparatus of claim 11 wherein each of the first and second hinged cross-members comprises a locking means that functions to snap into a locking position such that the two straight sections of each of hinged cross-member assembly are disposed at a 180° angle to one another.

13. A method for a user to perform a push-up exercise comprising the steps of:

(a) providing an exercise apparatus comprising:

a frame comprising: a first A-shaped component comprising two first A-shaped component frame legs each having a distal end and a proximal end, wherein the first A-shaped component frame legs are hingedly attached at the distal ends thereby defining a first A-shaped component apex; and a second A-shaped component comprising two second A-shaped component frame legs each having a distal end and a proximal end, wherein the second A-shaped component frame legs are hingedly attached at the distal ends thereby defining a second A-shaped component apex; wherein the proximal end of at least one of the two frame legs of each A-shaped component is attached to a base;

a crossbar having a first crossbar end and a second crossbar end wherein the crossbar is disposed between the first A-shaped component and the second A-shaped component wherein the first crossbar end is slidably attached to one of the two first A-shaped component frame legs and the second crossbar end is slidably attached to one of the two second A-shaped component frame legs;

one or more pulley systems attached to at least one A-shaped component frame leg, wherein the one or more pulley systems comprise one or more elongate elastic tension means having a proximal end removably attachable to the at least one A-shaped component frame leg and a distal end removably attachable to the crossbar; and a seating means attached to the crossbar;

(b) disposing at least one of the one or more of the elongate elastic tension means in a selected position to provide a desired overall tension/resistance;

(c) disposing the frontal midsection of the body of the user upon the seating means;

(d) disposing the hands of the user with palms facing down in front of the frame while the feet of the user are disposed behind frame and legs of the user are straightened; and (e) alternately raising and lowering the body of the user by the use of the arms of the user while maintaining the body of the user and legs of the user in an extended straightened position.

* * * * *